US005772185A

United States Patent [19]

Pulsipher

[11] Patent Number: 5,772,185

[45] Date of Patent: Jun. 30, 1998

[54] RESILIENT WALL CAP

[76] Inventor: Larry W. Pulsipher, 435 S. 1690 East, Fruit Heights, Utah 84037

[21] Appl. No.: 719,006

[22] Filed: Sep. 24, 1996

[51] Int. Cl.[6] ..... E04C 1/39

[52] U.S. Cl. ..... 256/59; 256/1; 52/465; 52/459

[58] Field of Search ..... 52/465, 459, 58, 52/300, 242; 256/1, 32, 59

[56] References Cited

U.S. PATENT DOCUMENTS

| | | | |
|---|---|---|---|
| 370,437 | 9/1887 | Wright | 52/300 X |
| 2,232,905 | 2/1941 | Dyer . | |
| 2,281,092 | 4/1942 | Andrews et al. . | |
| 2,975,561 | 3/1961 | Branham . | |
| 3,109,260 | 11/1963 | De Cesare . | |
| 3,802,140 | 4/1974 | Hickman . | |
| 3,862,531 | 1/1975 | Attaway et al. . | |
| 3,872,633 | 3/1975 | Altosaar et al. | 52/242 X |
| 3,915,328 | 10/1975 | Hawes et al. | 52/459 X |
| 4,000,597 | 1/1977 | Burton . | |
| 4,543,758 | 10/1985 | Lane | 52/465 X |
| 4,789,138 | 12/1988 | Acton . | |
| 4,926,595 | 5/1990 | Dean, Jr. . | |
| 5,280,692 | 1/1994 | Patey | 52/58 X |
| 5,289,662 | 3/1994 | Castle . | |
| 5,326,187 | 7/1994 | St. Marie et al. . | |
| 5,388,379 | 2/1995 | Lamberti . | |

FOREIGN PATENT DOCUMENTS

| | | | |
|---|---|---|---|
| 973225 | 10/1964 | United Kingdom | 52/459 |

*Primary Examiner*—Anthony Knight
*Attorney, Agent, or Firm*—Thorpe, North & Western

[57] ABSTRACT

A protective cap for covering a top of a wall. The cap is constructed in the form of an elongate channel having an upper plate and opposing sidewalls. Each sidewall tapers inwardly to an innermost side edge, then slants outwardly from that edge. The sidewalls are preferably flexible and resilient with sufficient elastic memory to function cooperatively as a gripper. The cap is placed onto the top of an outdoor wall, with the upper plate of the cap disposed along the top and the sidewalls extending downwardly along opposing sides of the outdoor wall. The cap is constructed such that the outdoor wall is wider than the distance between the innermost side edges when the sidewalls of the cap reside in a natural, unbiased position.

12 Claims, 2 Drawing Sheets

RESILIENT WALL CAP

BACKGROUND OF THE INVENTION

1. The Field of the Invention

The present invention relates generally to wall coverings. More particularly, it concerns a resilient, protective cap attachable along the top of a wall.

2. The Background Art

Outdoor walls, like all outdoor structures, are subject to weathering and degradation from exposure to the elements. The top portion of an outdoor wall is particularly susceptible to the effects of weathering, especially walls having a flat, horizontal upper surface that collects moisture. The tops of brick and cinder block walls often erode and crumble in response to regular weather cycles of freezing and thawing.

Several attempts have been made to improve the durability of wall tops. For example, it is known to cover the top of a wall or fence with a shield to block moisture and direct sunlight from contacting it. U.S. Pat. No. 5,325,187 (issued on Jul. 5, 1994 to St. Marie et al.) reveals a railing cover for protecting fence rails. U.S. Pat. No. 4,789,138 (issued on Dec. 6, 1988 to Acton) discloses a fence protector which can be fastened along the top of a fence. U.S. Pat. No. 3,862,531 (issued on Jan. 28, 1975 to Attaway et al.) teaches a coping structure for covering the top of a wall. These are three of several different prior art patents which disclose some kind of a wall covering.

The prior art attempts to protect wall tops are characterized by several disadvantages. The thinking in the field of wall covers has been to attach the cover by piercing the wall with fastening elements, or, if the wall top comprises overhanging flanges, to encapsulate the wall top around the flanges.

For example, the St. Marie et al. patent teaches a cover which is laborious and time-consuming to install. The cover includes right-angle flange elements which fold around an overhanging fence rail.

The fence protector disclosed in the Acton patent is a metal channel which conducts heat and is fastened by sharp cut-out portions which are wedged into the fiber of a wooden fence. The high rate of heat conduction would still have an undesirable impact on the durability of the fence, and the cut-out portions produce openings in the cover which would permit some moisture to pass through the cover. Moreover, such a device is impractical for use with brick or cinder block walls because the sharp fastening portions cannot penetrate masonry effectively and would themselves contribute to degradation of the wall.

The coping structure of the Attaway et al. patent is overly complex in design and installation. The device includes several internal layers and requires the aid of nails for attachment to a wall.

OBJECTS AND SUMMARY OF THE INVENTION

It is therefore an object of the present invention to provide a protective wall cap which is simple in design and manufacture.

It is another object of the present invention to provide such a wall cap which is more easily attachable to and removable from a wall top.

It is further object of the present invention, in accordance with one aspect thereof, to provide a wall cap which is flexible and designed to grip the top of a wall.

It is an additional object of the invention, in accordance with one aspect thereof, to provide a resilient wall cap having elastic memory.

It is yet another object of the invention, in accordance with one aspect thereof, to provide a wall cap which channels moisture away from the wall.

It is still another object of the invention, in accordance with one aspect thereof, to provide a wall cap which is nonconductive of electricity.

The above objects and others not specifically recited are realized in a specific illustrative embodiment of a protective cap for covering a top of a wall. The cap is constructed in the form of an elongate channel having an upper plate and opposing sidewalls. Each sidewall tapers inwardly to an innermost side edge, then slants outwardly from that edge. The sidewalls are preferably flexible and resilient with sufficient elastic memory to function cooperatively as a gripper. The cap is placed onto the top of an outdoor wall, with the upper plate of the cap disposed along the wall top and the sidewalls extending downwardly along opposing sides of the wall. The cap is constructed such that the outdoor wall is wider than the distance between the innermost side edges when the sidewalls of the cap reside in a natural, unbiased position.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
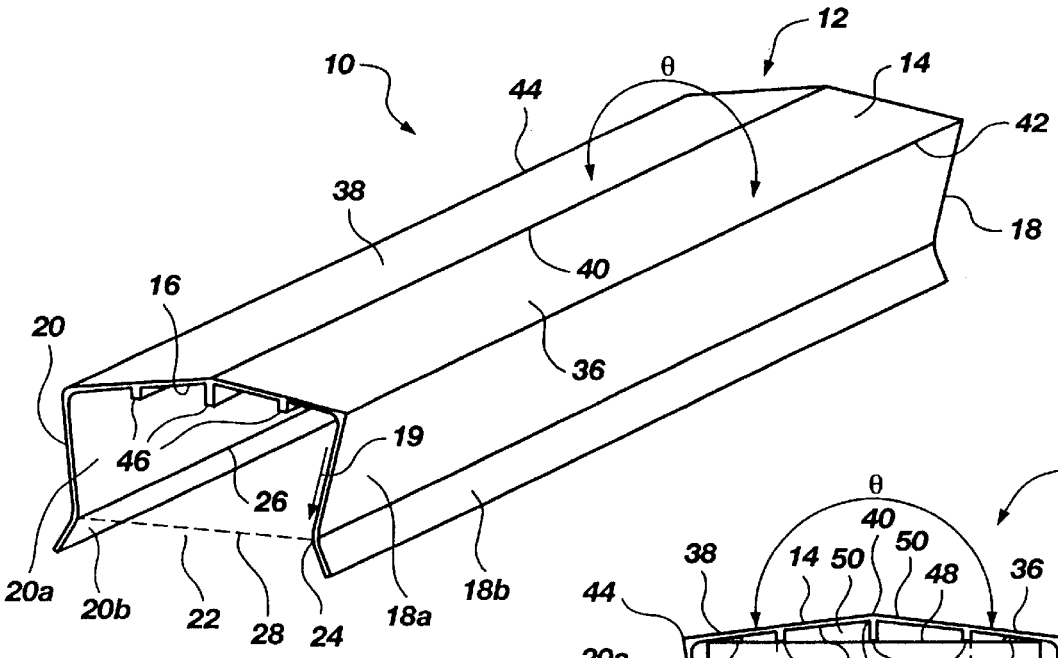
FIG. 1 is a perspective view of a wall cap made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated device, and any additional applications of the principles of the invention as illustrated herein, which would normally occur to one skilled in the relevant art and possessed of this disclosure, are to be considered within the scope of the invention claimed.

Figure 2:
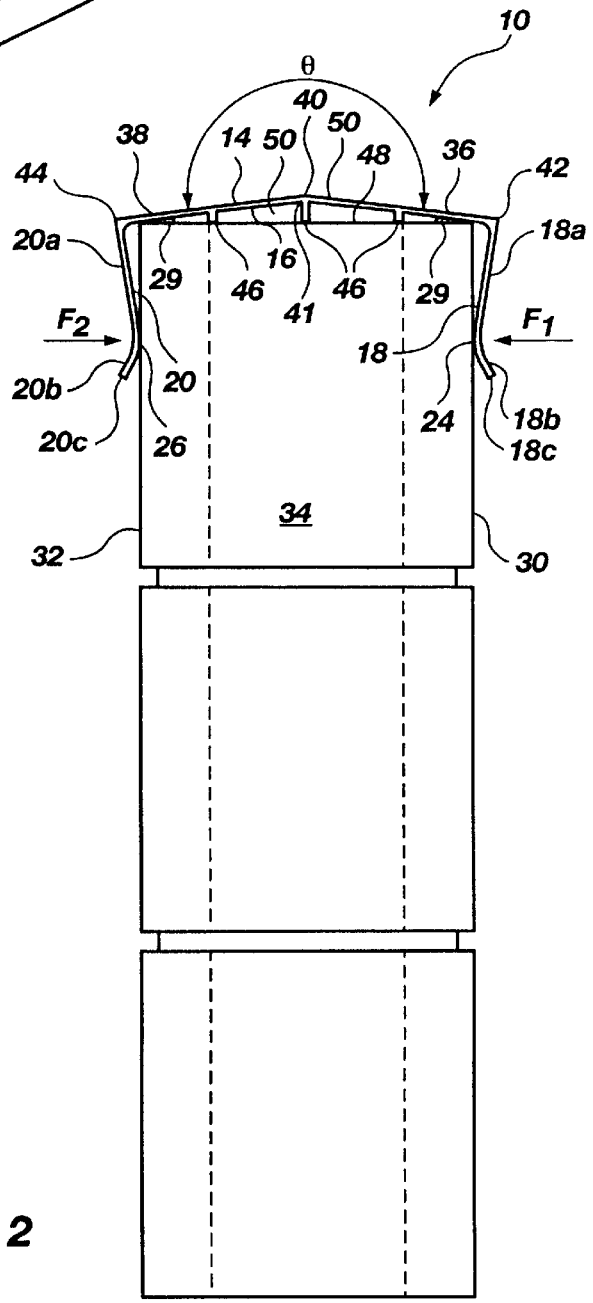
FIG. 2 is a front view of the wall cap of FIG. 1 mounted upon the top of an outdoor wall.
Figure 3A:
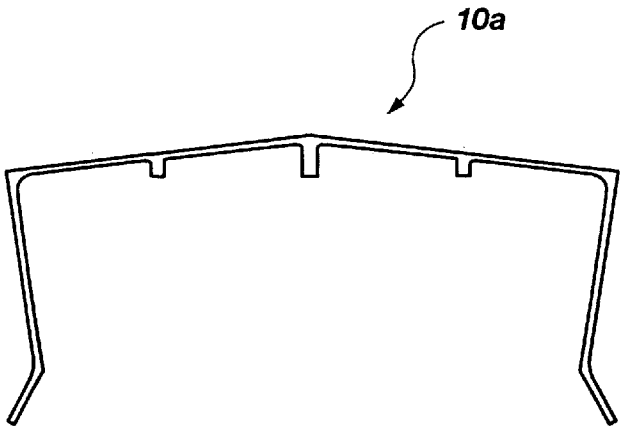
FIGS. 3A, 3B, 3C and 3D illustrate alternative dimensions of the wall cap of FIGS. 1 and 2.
Figure 3B:
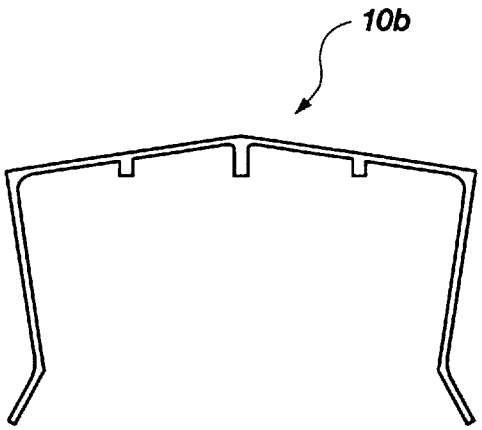
Figure 3C:
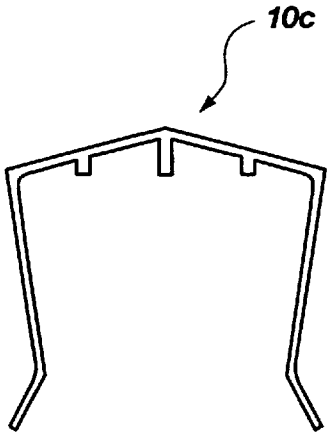
Figure 3D:
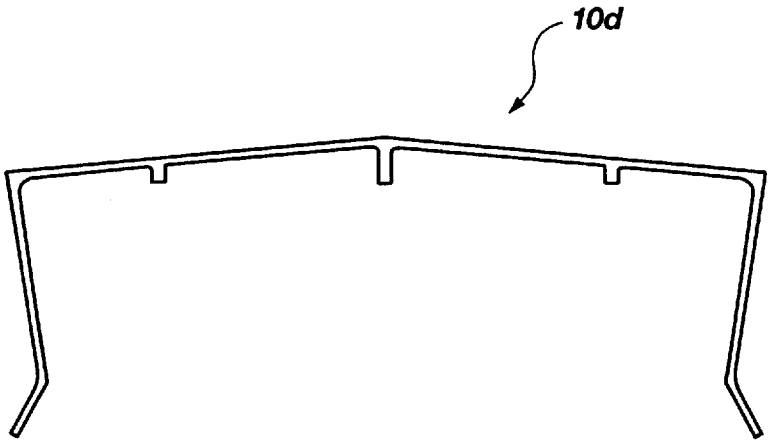

Referring now to FIGS. 1–2, there is shown a protective wall cap, designated generally at 10. The wall cap 10 includes an elongate upper plate 12 having upper and lower opposing surfaces 14 and 16. First and second elongate opposing sidewalls 18 and 20 extend outwardly from the lower surface 16 of the upper plate 12 such that the upper plate 12 and sidewalls 18 and 20 cooperatively form a three-sided channel defining an enclosure 22 for receiving a top end of a free-standing wall 34.

The wall cap 10 is attachable over an upper planer surface 48 of the wall 34 as shown in FIG. 2. The wall cap 10 is preferably constructed in several sections which are individually attached in sequential, abutting contact along the top of the wall 34.

Each sidewall 18 and 20 preferably comprises two adjoining panels which define a nonstraight angle therebetween. The phrase "nonstraight angle" as used herein refers to any angle other than a 180 degree angle. For example, sidewall 18 includes upper and lower panels 18*a* and 18*b*, and sidewall 20 includes upper and lower panels 20*a* and 20*b*, extending along substantially entire lengths of said first and second sidewalls 18 and 20.

The upper panels 18*a* and 20*a* taper inwardly toward each other in an upper-to-lower direction and terminate in first and second innermost side edges 24 and 26, respectively. The innermost side edges 24 and 26 extend along substantially the entire lengths of the first and second sidewalls 18 and 20 and cooperatively define a lateral distance 28 therebetween.

The directional terms "inwardly", "outwardly", "upwardly", "downwardly", "upper-to-lower" and "lower-to-upper" as used herein are gauged with respect to the enclosure 22, when the lower surface 16 of the wall cap 10 is facing downwardly as shown in FIGS. 1–2. For example, arrow 19 illustrates the directional orientation of the upper panel 18*a* described herein as tapering inwardly toward the opposing upper panel 20*a* in an upper-to-lower direction, meaning that as it tapers inwardly into the enclosure 22, it also extends from an upper to a lower direction, or downwardly. This same directional orientation could also be described as the upper panel 18*a* tapering outwardly in a lower-to-upper direction, since the outward tapering occurs directionally from a lower to an upper direction, or upwardly.

Further, the lower panel 18*b* is preferably slanted outwardly with respect to said upper panel 18*a* as shown. As such, the lower panels 18*b* and 20*b* of the first and second sidewalls 18 and 20 can be described as extending outwardly is with respect to the enclosure 22 in opposing directions with respect to each other. One of the advantages of the lower panels 18*b* and 20*b* is that they operate as channel gutters or "drip edges" for channeling moisture away from the wall 34 to thereby reduce the eroding effects of the moisture. Specifically, the lower panels 18*b* and 20*b* terminate in outward edges 18*c* and 20*c*, respectively, from which any moisture will drip. Since the outward edges 18*c* and 20*c* are spaced apart from sides 30 and 32 of the wall 34, the moisture will drip away from the wall and onto the ground.

The wall cap 10 is preferably constructed from a resilient plastic material having elastic memory biasing means for forcing the innermost side edges 24 and 26 into engagement against opposing sides 30 and 32 of the wall 34, wherein the wall 34 is wider than the lateral distance 28 between the innermost side edges 24 and 26 when said sidewalls are in a natural unbiased position, and when the wall 34 has been inserted into the enclosure 22 to force apart said sidewalls. The wall cap 10 thereby operates to exert opposing lateral forces depicted by arrows $F_1$ and $F_2$ against the wall sides 30 and 32. The gripping forces $F_1$ and $F_2$ operate as attachment means for attaching the wall cap 10 to the wall 34. Additionally, any suitable adhesive 29 may optionally be used to bond first and second side sections 36 and 38 to the upper surface 48 of the wall 34. Preferably, the upper plate 12 and the sidewalls 18 and 20 collectively comprise a one-piece, unitary, integral member constructed of resilient plastic material and being characterized by an absence of holes in the plastic material.

The upper plate 12 preferably comprises first and second elongate side sections 36 and 38 extending upwardly toward each other in opposing inward directions and being adjoined at an interior portion of the upper plate 12 to form an elongate upper male edge 40, preferably extending substantially along an entire length of said upper plate 12. The first and second side sections 36 and 38 include upper surfaces which define an angle θ therebetween which is preferably less than 220 degrees and greater than 180 degrees. The phrase "male edge" should be intuitively understood by inspection of item 40 in FIGS. 1–2. A "male edge" as used herein refers to an edge which protrudes, such as the edge of a book, and is not limited to sharp corners but may be a rounded section and includes any protruding component no matter how subtle, as opposed to a female edge which extends inward (as in female edge 41) instead of protruding.

The upper plate 12 is bounded by first and second side edges 42 and 44. A cross section of the wall cap 10 thus defines five corners of a pentagon such that the male edge 40, the first and second side edges 42 and 44, and the first and second innermost edges 24 and 26 respectively coincide with the five corners of the pentagon. The term "pentagon" as used herein shall refer to a polygon having five sides and five angles, regardless of whether the five sides are equal in length. The first and second elongate side sections 36 and 38 preferably have equivalent widths such that a cross-section of said side elongate sections defines two equivalent sides of an isosceles triangle.

The wall cap 10 further comprises a plurality of elongate reinforcing rib members 46 extending downwardly from the lower surface 16. The rib members 46 are preferably spaced equidistantly apart and positioned in a parallel orientation with respect to the male edge 40, wherein one of said rib members extends beneath and along the male edge. Each reinforcing rib member 46 preferably terminates in a substantially straight elongate distal edge such that all of said distal edges reside substantially common to a single plane. This enables all of the rib members 46 to abut against the upper planer surface 48 of the wall 34 as shown in FIG. 2 for a stable mounted position. In the event that loads are applied to the upper plate 12, the rib members 46 will help inhibit collapse of the upper plate and fractionalize the load along the upper surface 48. The wall cap 10 is easily adapted for use with many types of wall structures and geometries. Only a minimal amount of additional material is needed to produce the reinforcing rib members 46. Gaps 50 between the rib members 46 provide some temperature insulation to minimize expansion of materials.

Most preferably, the first and second side edges 42 and 44 also reside substantially common to the single plane defined by the distal edges of the ribs 46, as illustrated by the planer upper surface 48 of the wall 34 being abutted by each of those elements. Although the side edges 42 and 44 are spaced apart from the planer wall surface 48, their under sides abut the wall surface 48 along with the distal edges of the ribs 46, as shown.

The upper and lower panels 18*a*, 18*b* and 20*a*, 20*b* of each sidewall 18 and 20, respectively, are sufficiently slanted with respect to each other such that when the elastic memory means forces the innermost side edges 24 and 26 into engagement against opposing sides 30 and 32 of the wall 34, all of said upper and lower panels are disposed in a substantial nonparallel orientation with respect to the opposing sides 30 and 32 of said wall 34, as shown in FIG. 2, and without contacting the wall 34 other than along the innermost side edges 24 and 26 as shown. Accordingly, the first and second sidewalls 18 and 20 may be described as opposing gripping jaws.

In accordance with the features and combinations described above, a preferred method for covering a top of a wall includes the steps of:

(a) selecting an elongate cover having an upper plate and first and second sidewalls extending outwardly from one side of said upper plate such that the upper plate and sidewalls cooperatively form a three-sided enclosure, each sidewall comprising upper and lower adjoining panels which taper inwardly into an elongate junction comprising an innermost side edge extending along substantially an entire length of said sidewall such that the first and second sidewalls comprise first and second innermost side edges, respectively, which define a lateral distance therebetween; and (b) placing the cover onto a top of a wall which is wider than the lateral distance between the first and second innermost side edges when the sidewalls of the cap reside in a natural, unbiased position such that said wall extends into the enclosure and is gripped between said first and second innermost side edges and such that the upper and lower panels of the sidewalls are each disposed in a substantial nonparallel orientation with respect to sides of the wall.

The one-piece unibody nature of the wall cap 10 can be achieved in any suitable manner, such as by extrusion, or injection molding processes known in the art. Fiber reinforcement may be added in processes such as pultrusion if desired, to further enhance stiffness and strength. When a suitable polymeric material is used to construct the wall cap 10, it is thereby rendered flexibly resilient with elastic memory for gripping the upper section of the wall 34 so as to cover the planer upper surface 48. A presently preferred material for constructing the wall cap 10 is a vinyl plastic material.

FIGS. 3A, 3B, 3C and 3D show four presently preferred dimensional configurations of the wall cap 10, depicted as wall cap 10*a,* wall cap 10*b,* wall cap 10*c,* and wall cap 10*d,* respectively. These various dimensional configurations illustrate that the wall cap 10 may be constructed responsive to any wall shape, size or geometry desired.

It is to be understood that the wall cap 10 can be used in several different applications, and is particularly advantageous as a cover for any outdoor wall. Neighborhood wall enclosures, property line fences, false fronts of a building, fire walls between buildings and sound barriers may all be protected with the wall cap 10. The flexible, resilient nature of the first and second sidewalls 18 and 20 facilitates use of a single cap size to different wall widths.

It will be appreciated that the preferred polymeric composition of the wall cap 10 renders the wall cap nonconductive of electricity and therefore less able to transmit heat. This reduces the adverse impact of heat conduction on the durability of the wall or fence to which the wall cap 10 is applied. The one-piece polymeric construction of the wall cap 10 is also quite aesthetically appealing, and provides a finished, cosmetic appearance to the wall 34. The wall cap 10 covers any sharp edges which may be present along the upper portion of the wall 34, thereby reducing the chances of injury to persons crossing the wall.

Many additional advantages accrue from the inwardly-tapering configuration of the sidewalls 18 and 20. The elastic memory of the material used to construct the sidewalls 18 and 20 permits an inwardly-biased grip of the sidewalls against a wall or fence positioned therebetween. The inherent elastic memory of the material operates to provide a much easier method of attachment, and thus without the need to penetrate the wall 34 with nails or the like.

It is also to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A protective cap for covering a top of a wall, said cap comprising:

an elongate, integral cover having only an upper wall and first and second opposing side walls and being comprised of resilient material;

said cover including an elongate upper plate having a lower surface;

said first and second opposing sidewalls being coupled to the upper plate and projecting downwardly to form a three-sided channel defining an enclosure for receiving thereinto a top end of a free-standing wall, said sidewalls tapering inwardly toward each other in an upper-to-lower direction to first and second innermost side edges, respectively, said innermost side edges extending along substantially the entire lengths of said first and second sidewalls and cooperatively defining a lateral distance therebetween;

said cover being free of any additional attaching means other than the upper wall and first and second opposing sidewalls.

2. The protective cap as defined in claim 1, wherein said sidewalls are constructed from a resilient material comprising elastic memory means for forcing the sidewalls into engagement against opposing sides of a wall which (i) is wider than the lateral distance between the innermost side edges when the sidewalls are in a natural unbiased position and (ii) has been inserted into the enclosure to force apart said sidewalls.

3. The protective cap as defined in claim 1, wherein the upper plate comprises first and second elongate side sections extending upwardly toward each other in opposing inward directions and being adjoined at an interior portion of the upper plate to form an elongate upper male edge extending substantially along an entire length of said upper plate.

4. The protective cap as defined in claim 3, wherein the first and second side sections include upper surfaces which define an angle therebetween of greater than 180 degrees and less than 220 degrees.

5. The protective cap as defined in claim 3, wherein the upper plate is bounded by first and second side edges, and wherein a cross section of the cap defines five corners of a pentagon such that the male edge, first and second side edges and first and second innermost edges respectively coincide with said five corners of said pentagon.

6. The protective cap as defined in claim 3, wherein the first and second side sections have substantially equivalent widths such that a cross-section of said side sections defines two equivalent sides of an isosceles triangle.

7. The protective cap as defined in claim 6, wherein the opposing surfaces of the upper plate comprise upper and lower surfaces, said cap further comprising an elongate reinforcing rib member projecting outwardly from the lower surface and extending along the male edge.

8. The protective cap as defined in claim 3, wherein the upper plate comprises upper and lower opposing surfaces, said cap further comprising a plurality of elongate reinforcing rib members extending outwardly from the lower surface, said rib members being equidistantly spaced apart and positioned in a parallel orientation with respect to the male edge, wherein one of said rib members extends beneath and along the male edge.

9. The protective cap as defined in claim 8, wherein each reinforcing rib member terminates in a substantially straight elongate distal edge such that all of said distal edges reside substantially common to a single plane.

10. The protective cap as defined in claim 8, wherein the upper plate is bounded by first and second side edges and wherein each reinforcing rib terminates in a substantially straight elongate distal edge such that all of said distal edges and said first and second side edges reside substantially common to a single plane.

11. The protective cap as defined in claim 1, wherein the first and second sidewalls each comprise upper and lower panels which are adjoined along the innermost side edge of the sidewall, said lower panel being slanted outwardly with respect to said upper panel such that the lower panels of said first and second sidewalls extend outwardly in opposing directions with respect to each other.

12. The protective cap as defined in claim 1, wherein the upper plate and the side walls are integrally interformed from a resilient material and collectively comprise, a one-piece, unitary, integral member characterized by an absence of holes in said material.

* * * * *